US006976278B2

(12) United States Patent
Oetting et al.

(10) Patent No.: US 6,976,278 B2
(45) Date of Patent: Dec. 20, 2005

(54) COMMODE FOR WHEELCHAIR

(76) Inventors: Martha Oetting, 2408 Headland Dr., St. Charles, MO (US) 63301; Wayne Oetting, 2408 Headland Dr., St. Charles, MO (US) 63301; William Koeneker, 12852 Vista Ridge, St. Louis, MO (US) 63138

( * ) Notice: Subject to any disclaimer, the term of this patent is extended or adjusted under 35 U.S.C. 154(b) by 141 days.

(21) Appl. No.: 10/238,112

(22) Filed: Sep. 10, 2002

(65) Prior Publication Data

US 2004/0045083 A1 Mar. 11, 2004

(51) Int. Cl.[7] ..... A47K 11/06; A61G 7/02
(52) U.S. Cl. ..... 4/480; 297/188.09
(58) Field of Search ..... 4/458, 476, 478, 4/479, 480, 483, 485; 280/250.1, 304.1, 650; 297/130, 188.09, 188.1, 188.13, 233, 344.13, 344.14, 344.17, 330, DIG. 4

(56) References Cited

U.S. PATENT DOCUMENTS

| | | | | | |
|---|---|---|---|---|---|
| 2,748,834 | A | * | 6/1956 | Schwinn | 4/480 |
| 2,869,614 | A | * | 1/1959 | Wamsley | 4/480 |
| 2,942,648 | A | * | 6/1960 | Barsotti | 4/480 |
| 3,271,785 | A | | 9/1966 | DuBose | 4/134 |
| 4,296,506 | A | | 10/1981 | Stoute et al. | 4/480 |
| 4,550,455 | A | * | 11/1985 | Carson et al. | 4/480 |
| 4,840,390 | A | | 6/1989 | Lockard et al. | 280/250.1 |
| 4,949,408 | A | | 8/1990 | Tkrla | 5/86 |
| 5,224,754 | A | * | 7/1993 | Jeanes, III | 4/483 |
| 5,253,724 | A | | 10/1993 | Prior | 180/65 |
| 5,255,934 | A | | 10/1993 | Wilson | 280/657 |
| 5,285,535 | A | | 2/1994 | Stewart et al. | 4/480 |
| 5,564,136 | A | | 10/1996 | Cox | 4/480 |
| 5,577,753 | A | | 11/1996 | Pociask | 280/250.1 |
| 5,586,343 | A | | 12/1996 | Mayle | 4/480 |
| 5,608,925 | A | | 3/1997 | Porter | 4/480 |
| 5,944,338 | A | | 8/1999 | Simpson | 280/650 |
| 6,027,132 | A | | 2/2000 | Robinson et al. | 280/250.1 |
| 6,176,335 | B1 | | 1/2001 | Schaffner et al. | 180/65.1 |
| 6,199,647 | B1 | | 3/2001 | Schaffner et al. | 180/65.1 |
| 6,202,773 | B1 | | 3/2001 | Richey et al. | 180/6.5 |
| 6,279,936 | B1 | | 8/2001 | Ritchie et al. | 280/304.1 |
| 6,418,571 | B1 | * | 7/2002 | Cheng | 4/480 |

* cited by examiner

*Primary Examiner*—Tuan Nguyen
(74) *Attorney, Agent, or Firm*—Polsinelli, Shalton, Welte, Suelthaus PC

(57) ABSTRACT

A wheelchair, containing a seat having an opening, seat sections that substantially fill the opening, a commode, wherein the commode is beneath the opening in the seat, wherein the seat sections move vertically and horizontally to provide access to the commode.

22 Claims, 16 Drawing Sheets

COMMODE FOR WHEELCHAIR

FIELD OF THE INVENTION

The present invention relates to a commode for a wheelchair and a wheelchair containing a commode. The commode may be incorporated into the wheelchair during the manufacture of the wheelchair. In the alternative, the commode may be incorporated into existing wheelchairs as a retro-fit modification or component. The commode may also be used with both powered and non-powered wheelchairs.

BACKGROUND OF THE INVENTION

Individuals who are confined to a wheelchair and who also lack bladder and bowel control are often prevented from participating in many fundamental daily activities, e.g., shopping, visiting friends, attending church, and keeping appointments, as the fear of accidental bowel or bladder movements causing humiliation and embarrassment is overwhelming. Further compounding the problem is that the transfer of an individual from a wheelchair to a public commode or a commode that lacks proper lift mechanisms is difficult for the untrained care-giver. The transfer process is also physically detrimental to the individual being transferred as tissue breakdown from repeated transfers by lifting with a sling or other mechanism may occur. Individuals who lack bladder and bowel control and who are also confined to a wheelchair suffer from the fact that they are only able to venture from home for very short amounts of time. Further, such individuals require near constant assistance.

Powered wheelchairs provide a limited amount of workspace in the powered wheelchair that may be dedicated to a commode. The presence of a motor for powering the wheelchair as well as support structures and other lifting mechanisms severely limit the space in the construction of the powered wheelchair that may be dedicated to a commode.

Also, the operation of a commode function of a wheelchair needs to be easy to actuate for an operator with limited mobility and dexterity. Previous attempts to incorporate a commode into a wheelchair have required significant manual strength and dexterity to operate the commode function of the wheelchair.

Other problems with previous attempts to incorporate a commode into a wheelchair include the proper containment and disposal of waste. In some previous attempts to incorporate a commode into a wheelchair, waste was not adequately contained and/or separated from the general environment surrounding the operator. Further, disposal of the waste should be convenient and sanitary.

Other problems with respect to previous attempts to incorporate a commode function into a wheelchair include moving mechanisms and structures that can prove hazardous to a user resting on the moving mechanisms and structures. Wheelchairs with a commode function having doors or shutters that close and/or shut require careful and delicate construction to avoid injury to the operator.

SUMMARY OF THE INVENTION

The present invention is directed to a wheelchair having a seat, the seat having an opening, seat sections that substantially fill the opening in the seat, a commode, wherein the commode is beneath the opening in the seat, and wherein the seat sections move vertically and horizontally to provide access to the commode.

It is an aspect of the present invention to provide a commode that may be retro-fit into existing powered and non-powered wheelchairs.

It is an aspect of the present invention to provide a commode for a wheelchair that provides for convenient and sanitary disposal of waste.

It is an aspect of the present invention to provide a commode for a wheelchair that has a seat having two separate seat sections which drop vertically and move horizontally providing an opening to a waste receptacle.

It is an aspect of the present invention to provide a commode for a wheelchair that has moving parts which do not endanger the operator of the wheelchair.

It is an aspect of the present invention to provide a commode for a wheelchair that may be operated by merely toggling a switch.

It is an aspect of the present invention to provide independence to those individuals confined to wheelchairs.

These and other aspects of the present invention are achieved herein.

BRIEF DESCRIPTION OF THE DRAWINGS

The present invention is illustrated by the embodiments shown in the drawings, in which.

DETAILED DESCRIPTION OF THE PREFERRED EMBODIMENTS

The invention is particularly drawn to a wheelchair having a commode integral therein. The wheelchair may be powered or non-powered. The commode may be incorporated into the wheelchair during the manufacturing process of the powered or non-powered wheelchair. The present invention is also drawn to an embodiment of a commode retro-fit that may be incorporated into powered and non-powered wheelchairs.

As used herein, powered wheelchairs include wheelchairs containing means, such as an electric motor, for locomotion. Powered wheelchairs have proved invaluable for those confined to a wheelchair and lack the dexterity or manual strength to propel non-powered wheelchairs. The main components of a powered wheelchair include a frame, an electric motor for propelling the powered wheelchair, a battery for providing stored energy to the electric motor, a transmission for transferring power from the electric motor to drive wheels of the wheelchair, control means for operating the powered wheelchair, and a seat support platform.

In many powered wheelchairs, the seat support platform is mounted on a center post. The seat support platform may be elevated and lowered on the center post as desired by the operator. The center post is generally located in the center of a lateral plane of the powered wheelchair to ensure stability.

Common powered wheelchairs include, for example, the JAZZY® and PRIDE® power chairs made by the Pride Mobility Products Corporation, the QUICKIE® power chairs made by the Quickie Designs, Inc., and the ACTION™ power chairs made by the Invacare Corporation. Powered wheelchairs are also described in U.S. Pat. Nos. 6,202,773; 6,199,647; 6,176,335; and 5,253,724. Non-powered wheelchairs are described in U.S. Pat. Nos. 6,027,132; 6,279,936; and 4,840,390. The disclosure of each of these references is hereby incorporated by reference.

The present invention provides a commode for a wheelchair that may be used by the operator of the wheelchair without the operator of the wheelchair leaving the wheelchair or being transferred from the wheelchair. The commode is operated by toggling a switch. Thus, those individuals with enough manual dexterity to direct a powered wheelchair may also operate the commode of the present invention. The commode of the present invention may also be utilized by the operator without any third party assistance thus providing the operator with significant independence.

A wheelchair with a commode of the present invention requires a modification to a standard seat or support area for the operator. The seat or support area of a wheelchair incorporating the commode must have an opening in the seat or support area. The shape of the opening is not limited to a particular shape and may be, for example, rectangular, circular, ovular, or variations thereof. The size of the opening is dependent on the size of the wheelchair and the size of the operator.

Figure 1:
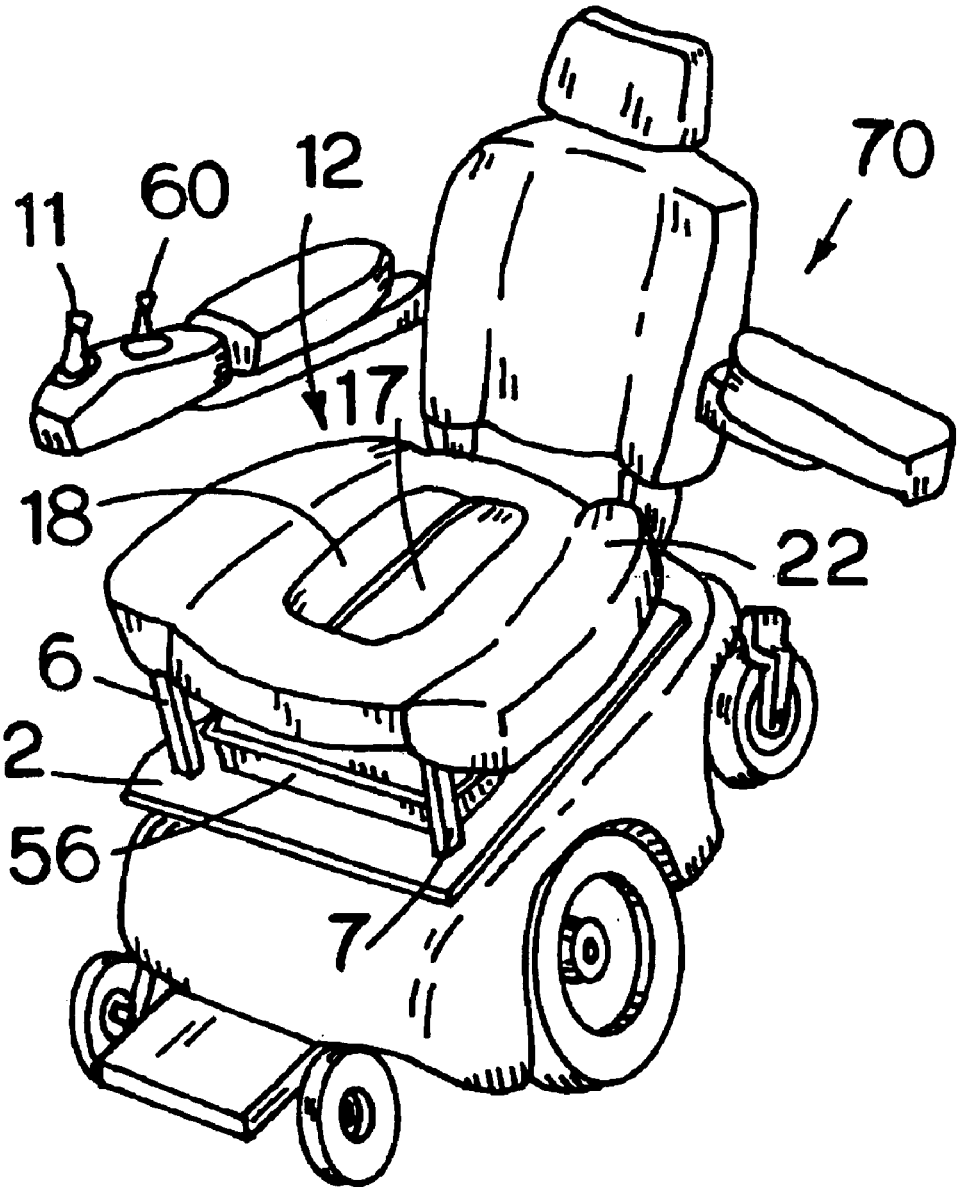
FIG. 1 is a perspective view of a powered wheelchair with a commode.
Figure 2:
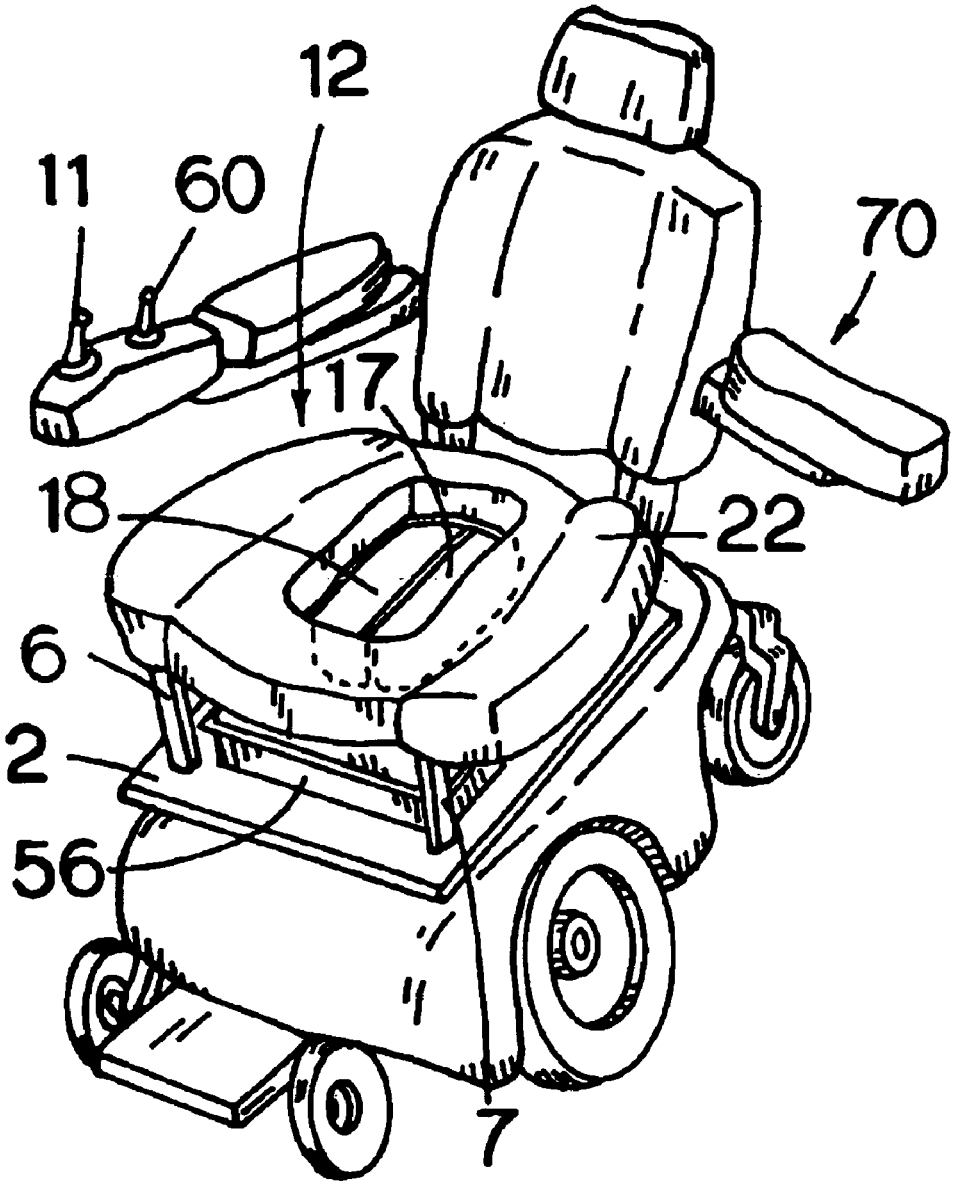
FIG. 2 is a perspective view of the powered wheelchair with the commode with left and right seat assemblies lowered.
Figure 3:
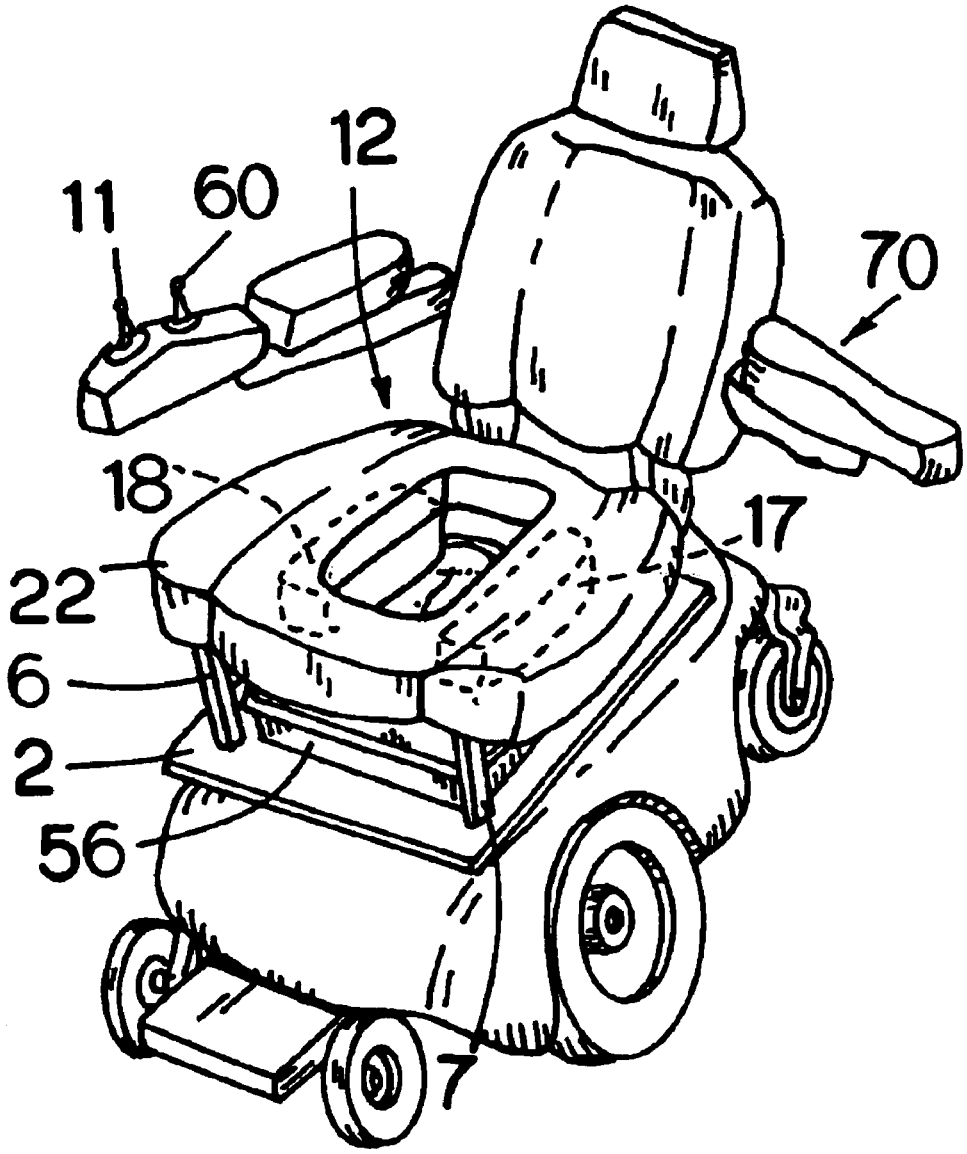
FIG. 3 is a perspective view of the powered wheelchair with the commode with the left and right seat assemblies moved horizontally.

A powered wheel chair 70 having a commode incorporated therein is shown in FIGS. 1–4. A bottom base plate 2 supports the commode and chair portions of the wheelchair. A control 11 operates the direction and movement of the powered wheel chair. Front left support leg 6 and front right support leg 7 support seat cushion 22. The seat cushion 22 is shown with an opening 12 in the seat cushion 22. The opening 12 in the seat cushion 22 is substantially filled with right seat cushion 17 and left seat cushion 18. FIGS. 1–3 show the movements of the right seat cushion 17 and the left seat cushion 18 to reveal a waste collection assembly 56.

Figure 5:
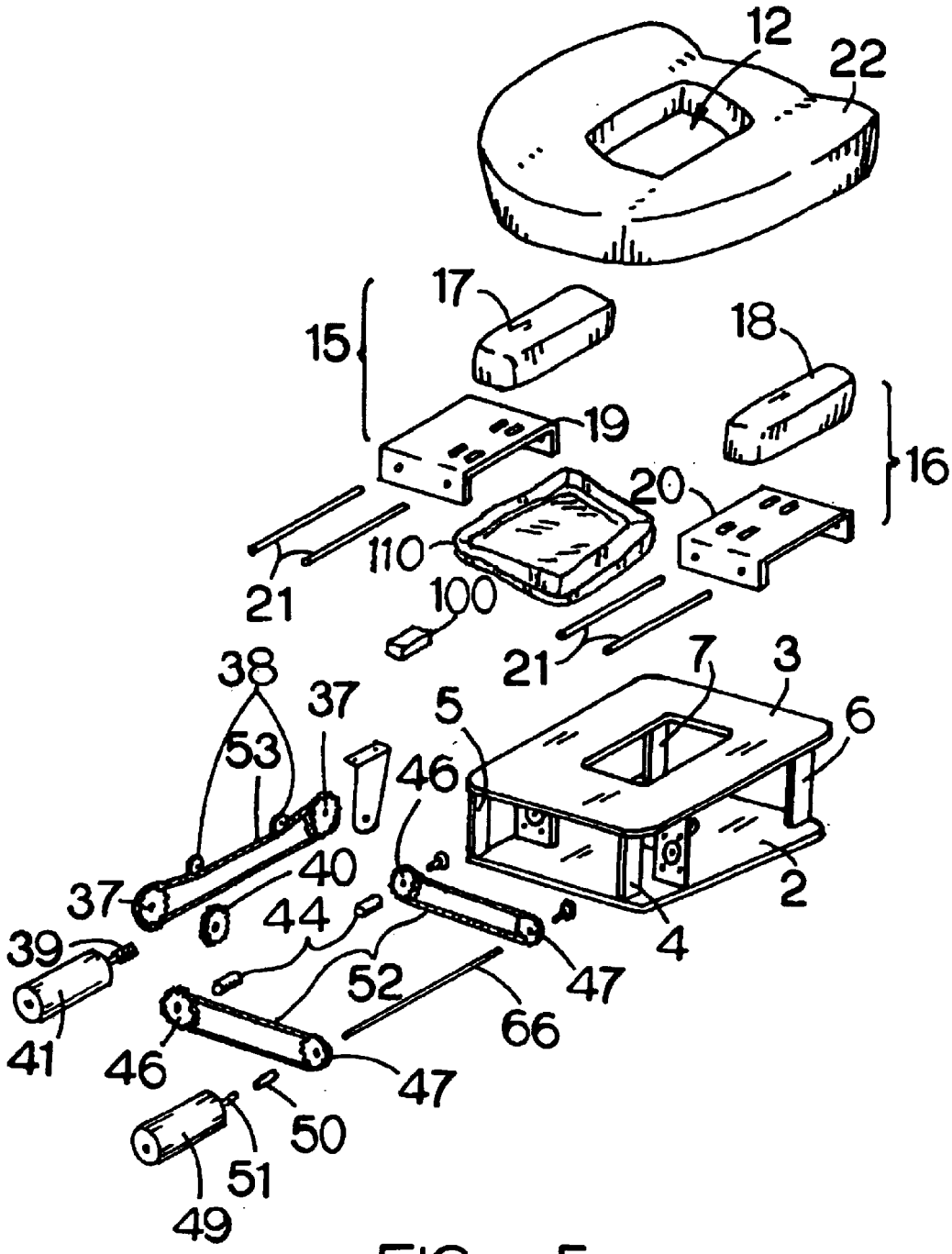
FIG. 5 is an exploded view of the commode.
Figure 7:
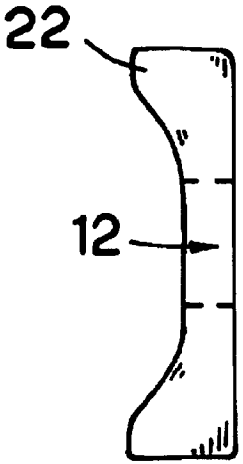
FIG. 7 is a rear sectional elevation of the seat.
Figure 6:
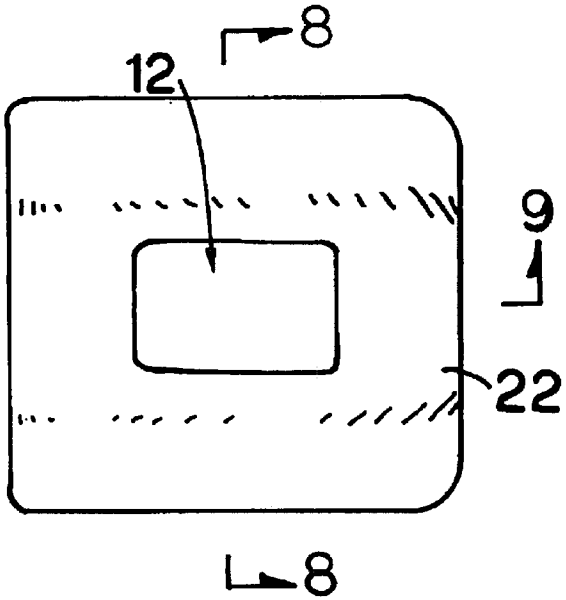
FIG. 6 is a top sectional elevation of the seat.
Figure 9:
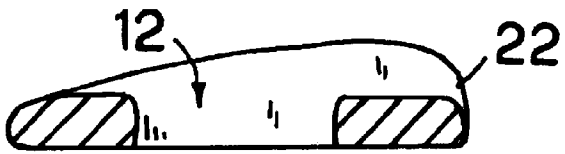
FIG. 9 is a side sectional elevation view of the seat taken along line 9—9 in FIG. 6.
Figure 8:
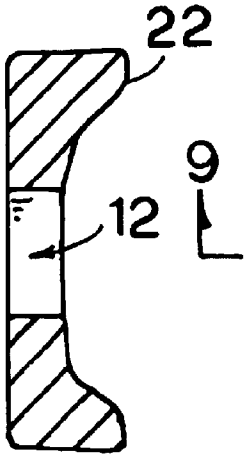
FIG. 8 is a front sectional elevation view of the seat taken along line 8—8 in FIG. 6.
Figure 12:
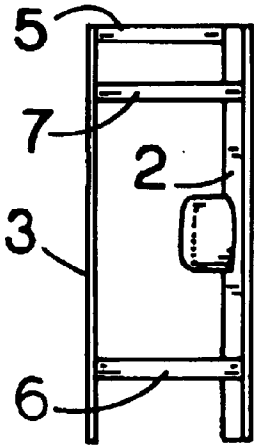
FIG. 12 is a rear view of the bottom base plate and the seat support base plate.
Figure 10:
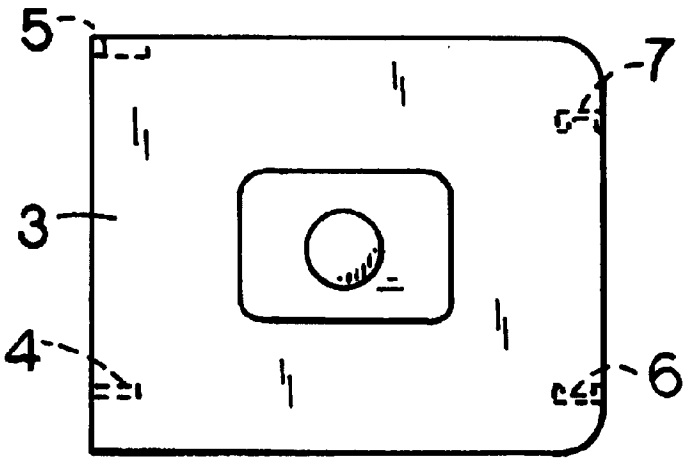
FIG. 10 is a top view of a bottom base plate and a seat support base plate.
Figure 11:
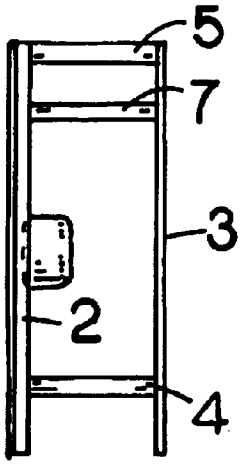
FIG. 11 is a front view of the bottom base plate and the seat support base plate.

A left seat assembly 16 and a right seat assembly 15 are shown in FIG. 5. The left seat assembly 16 is topped with the left seat cushion 18 and the right seat assembly 15 is topped with the right seat cushion 17.

The left seat assembly 16 and the right seat assembly 15 fill or substantially fill the opening 12 in the seat cushion 22 to provide the operator of the wheelchair with uniform support. The left seat assembly 16 and the right seat assembly 15 are substantially flush or level with the seat cushion 22. It is important to provide the operator with uniform support to ensure comfort and reduce contact injuries such as bedsores. In the embodiment shown in FIGS. 1–3, the opening 12 in the seat cushion 22 is substantially rectangular. The seat cushion 22 may also optionally be made of two or more different seat cushion members which define the opening 12.

Seat cushion 22, the right seat cushion 17, and the left seat cushion 18 may be made from standard seat cushion materials that provide cushioning and support to the operator. Preferably, the supporting surfaces of seat cushion 22, the right seat cushion 17, and the left seat cushion 18 are covered or layered with a washable material, i.e., a slip cover, that may be removed, washed, and returned to the supporting surfaces.

In operation of the commode of the present invention, the operator toggles a start switch 60 which electronically initiates the commode by mechanically lowering right seat assembly 15 and left seat assembly 16. While a toggle switch is shown, one of ordinary skill in the art will recognize that other switches can be used. Wiring of the wheelchair of the present invention will also be readily apparent to one of ordinary skill in the art. Preferably, the right seat assembly 15 and the left seat assembly 16 are lowered simultaneously. In a most preferred embodiment, the right seat assembly 15 and the left seat assembly 16 do not substantially separate until the lowering of the right seat assembly 15 and the left seat assembly 16 is completed.

After the lowering of the right seat assembly 15 and the left seat assembly 16, both seat assemblies move horizontally or laterally to provide access to a waste collection assembly 56. It is preferred that the right seat assembly 15 moves to the right, i.e., toward the right exterior portion of the wheelchair and away from the opening 12 in the seat cushion 22. It is preferred that the left seat assembly 16 move toward the left of the wheelchair, i.e., away from the opening 12 in the seat cushion 22.

After both the right seat assembly 15 and the left seat assembly 16 have moved horizontally, the wheelchair commode is in an open position such that the operator may utilize the waste collection assembly 56. After utilization of the waste collection assembly 56, the operator may again toggle the switch and initiate a closing procedure for the commode. In the closing procedure, the right seat assembly 15 and the left seat assembly 16 operate in reverse of the opening procedure, i.e., the right seat assembly 15 and the left seat assembly 16 move horizontally toward the center of the opening 12 of the seat cushion 22 and then raise vertically to once again form a substantially uniform support surface for the operator. Preferably, before the right seat assembly 15 and the left seat assembly 16 begin their vertical movement, the right seat assembly 15 and the left seat assembly 16 have substantially completed their horizontal movement. Thus, the substantially uniform support surface moves toward the operator and pinching is reduced or eliminated.

Figure 13:
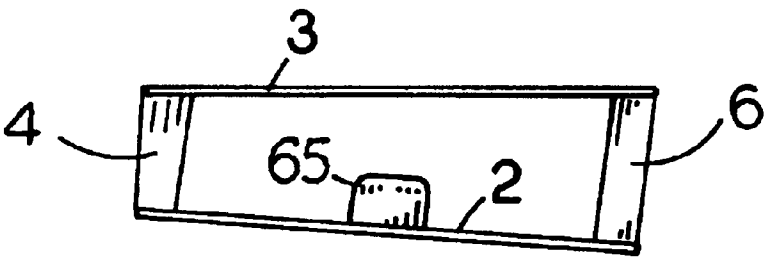
FIG. 13 is a side view of the bottom base plate and the seat support base plate.

The design of a commode for a powered wheelchair is constrained by many factors. First, the working area below the seat cushion in a powered wheelchair contains a motor and drive means for powering the wheelchair. Also, most powered wheelchairs have a seat lift function where the seat raises vertically or lowers vertically on a center post, such as for example, a center post 65 shown in FIG. 13. Thus, it is preferred that the waste collection assembly 56 moves vertically when the entire seat structure moves vertically via the center post 65. Finally, the seat of a wheelchair may only be raised to a certain maximum level and still ensure stability. If the seat of a wheelchair is raised too high to accommodate a commode, stability of the entire wheelchair may be jeopardized.

Figure 14:
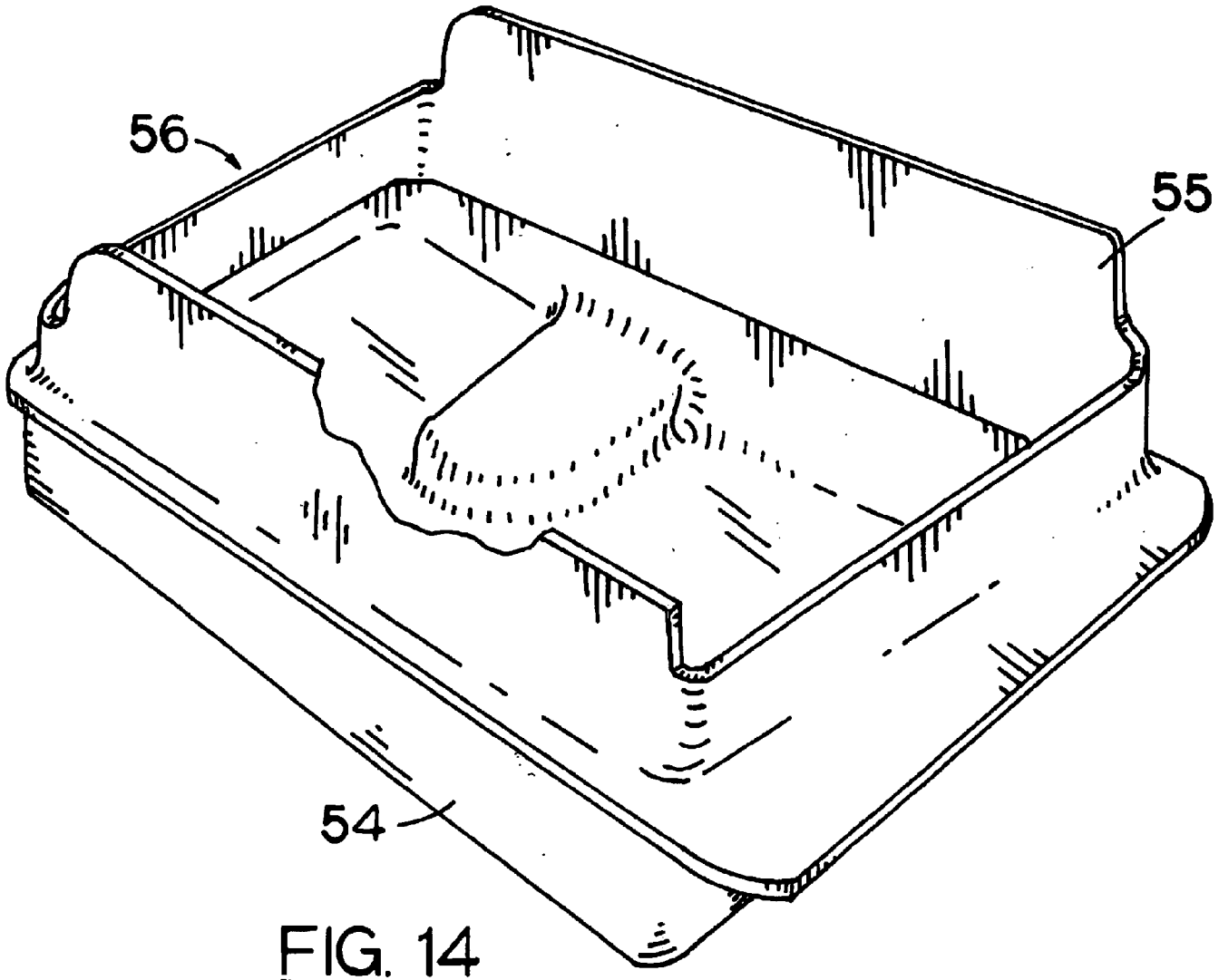
FIG. 14 is a perspective view of a waste collection tray.

The center post that is typical of most powered wheelchairs requires that a commode have a specialized waste receptacle. An example of a specialized waste receptacle is waste collection assembly 56 of the present invention. As shown in FIG. 14, the waste collection assembly 56 of the present invention has a roughly "c" shaped embossment that conforms around the center post 65 (shown in FIGS. 10–13) and yet will slide out of the commode assembly as it rests on a bottom base plate 2. The embossment may also be, for example, horseshoe-shaped, "u" shaped, or substantially square or rectangular shaped. The bottom 54 of the waste collection assembly 56 rests on the bottom base plate 2. The waste collection assembly may be made from a durable, washable material, such as a hard plastic. The top 55 of the waste collection assembly 56 assists in maintaining the waste in the collection assembly 56. Preferably, the material is resistant to a chemical additive which may be contained or placed in the receptacle as needed to aid in neutralization and control of the waste products received in the receptacle.

FIGS. 10–13 also show seat support base plate 3 which is supported on the bottom base plate 2 by the front left support by 6, the front right support leg 7, rear left support leg 4, and rear right support leg 5.

Figure 4:
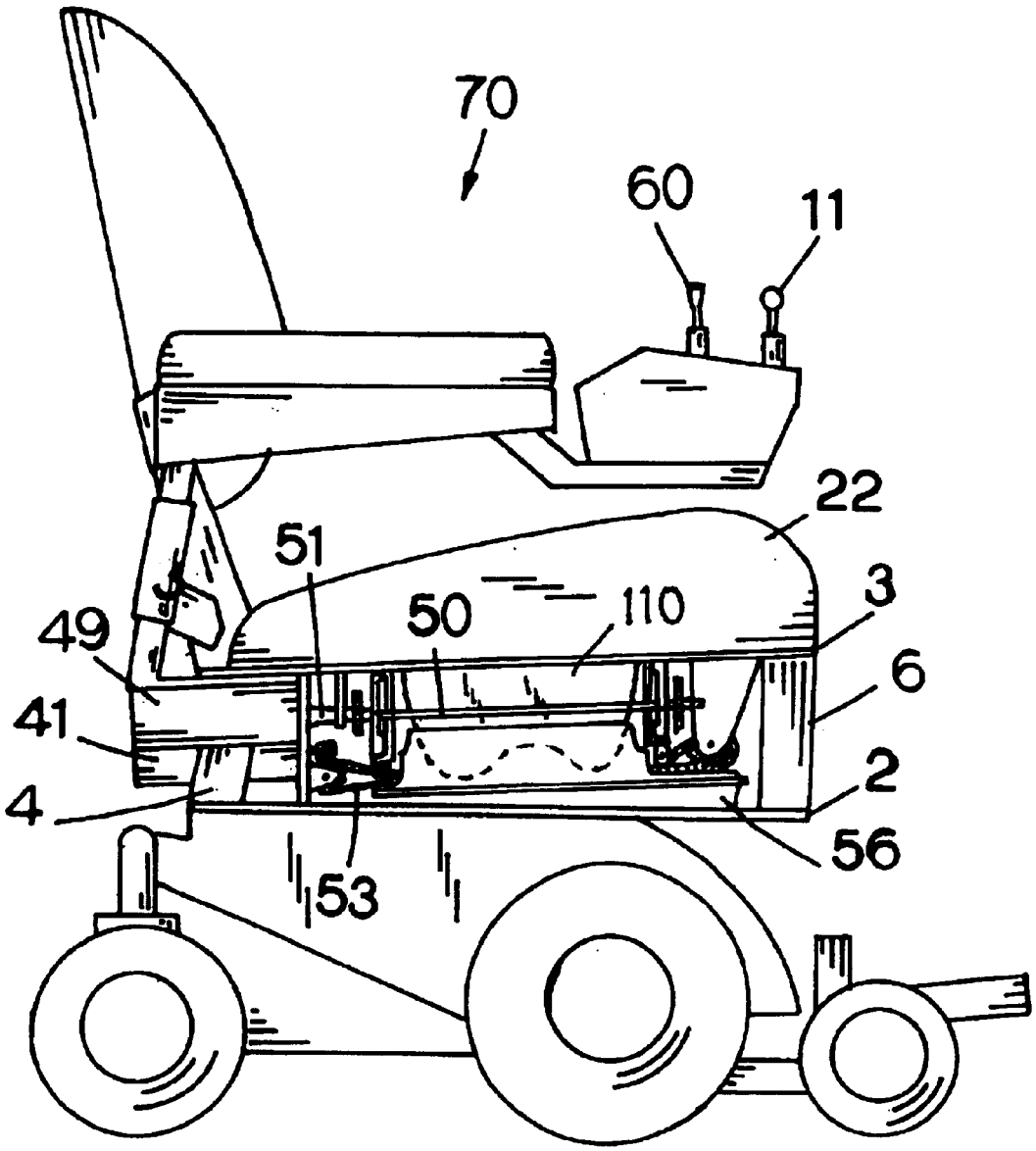
FIG. 4 is a sectional representation of a left side view of the powered wheelchair with the commode.

In other embodiments, the waste collection assembly 56 may be replaced or used in conjunction with a disposable bag that may either rest inside the waste collection assembly 56 or lie on top of a disposable bag support. The disposable bag may be disposed of after use and replaced with another fresh bag. A disposable bag 110 is shown in FIGS. 4 and 5. The disposable bag provides the operator with a sanitary and convenient system for disposal of waste.

In a most preferred embodiment, the disposable bag has positive sealing means, such as velcro fasteners, magnetic strips, or other closing means that positively open and close the bag. As the left seat assembly 16 and the right seat assembly 15 are opened, the disposable bag is preferably attached to the left seat assembly 16 and the right seat assembly 15 and opens with the left seat assembly 16 and the right seat assembly 15. Further, it is especially preferred that the disposable bag closes with the closing of the right seat assembly 15 and the left seat assembly 16. Thus, the commode closes and seals the waste inside the disposable bag. The disposable bag may be attached to the right seat assembly 15 and the left seat assembly 16 by attaching means such as velcro, frictional clips, adhesives, snaps, or grommeted eyes in the disposable bag that overlay optional receiving protrusions in an edge or surface of the right seat assembly 15 or the left seat assembly 16.

Figure 15:
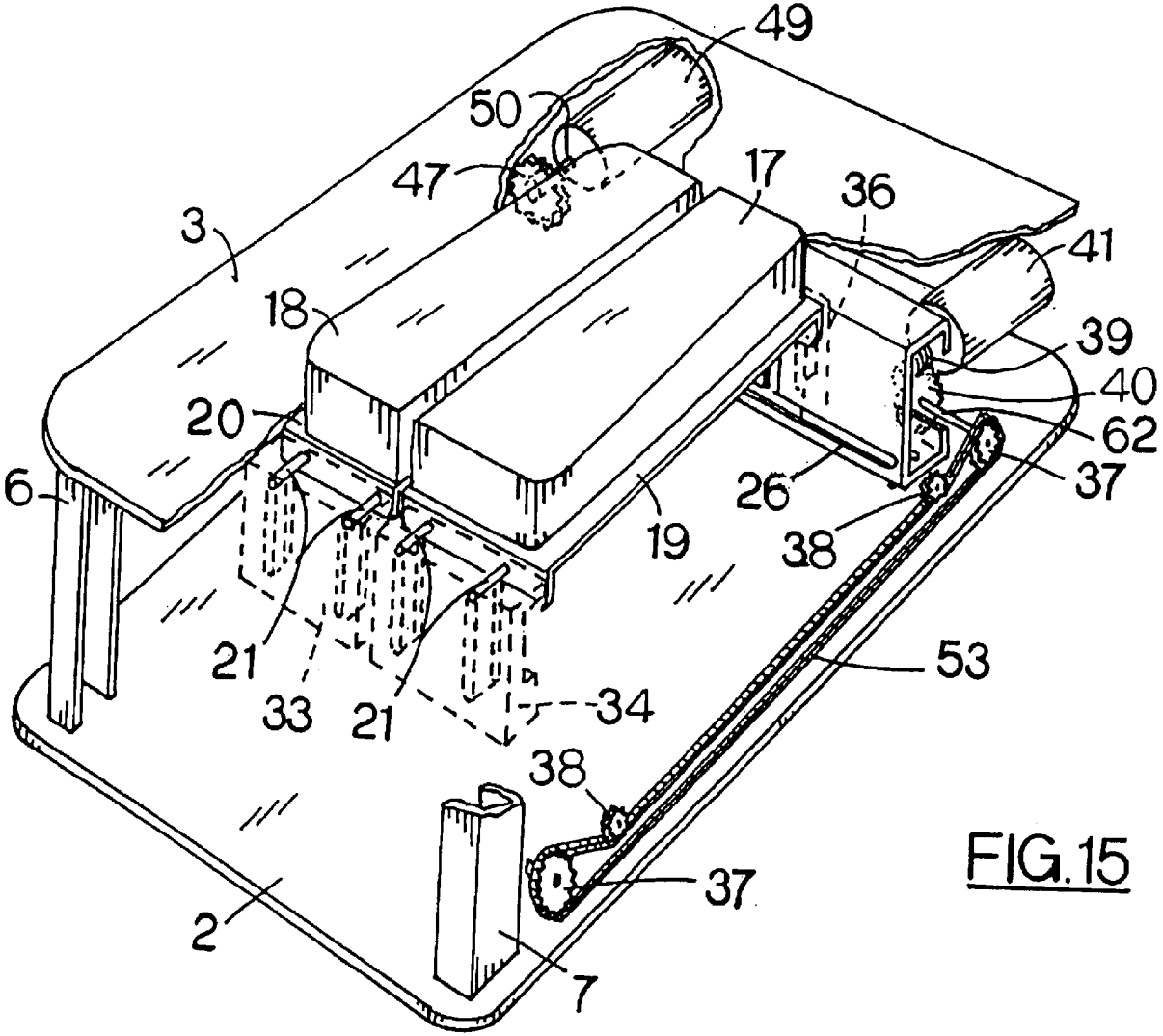
FIG. 15 is a perspective and schematic view of the commode.

Another important feature of the present invention are two motors to separately and serially actuate the vertical and horizontal movements of the seat sections. In one embodiment of the present invention as shown in FIG. 15, the elevator motor 49 is responsible for the vertical movements of the right seat assembly 15 and the left seat assembly 16, while the side travel motor 41 is responsible for the horizontal movements of the right seat assembly 15 and the left seat assembly 16.

In another embodiment of the present invention, an electronic eye 100 or other light beam mechanism may be used in the opening 12 to terminate closing of the left seat assembly 16 and the right seat assembly 15 when an obstruction is detected in the opening 12.

It is important that the left seat assembly 16 and the right seat assembly 15 move vertically away from the operator and moves vertically toward the operator since incidents of pinching are significantly reduced or eliminated. This elimination or reduction of pinching is especially important when the left seat assembly 16 and the right seat assembly 15 are returning to a closed position.

In operation of the commode, i.e. to "open" the commode, the operator toggles the switch 60 causing the elevator motor to initiate and lower the right seat assembly 15 and the left seat assembly 16. After completing the lowering movement of the right seat assembly 15 and the left seat assembly 16, the elevator motor 49 is automatically shut off and the side travel motor 41 is initiated to move the right seat assembly 15 and the left seat assembly 16 horizontally. It is important to note that the opening process is initiated by merely toggling the switch 60.

When the operator desires to "close" the commode, the operator toggles switch 60 initiating side travel motor 41 to move the right seat assembly 15 and the left seat assembly 16 horizontally towards the center of the wheelchair. After completing the horizontal movement, the side travel motor 41 is automatically shut off and the elevator motor 49 is initiated to move the right seat assembly 15 and the left seat assembly 16 vertically to a substantially flush position or level with the seat cushion 22. This ease of operation is especially important to an operator with limited manual dexterity.

The invention will now be further explained by way of the following example.

Figure 17:
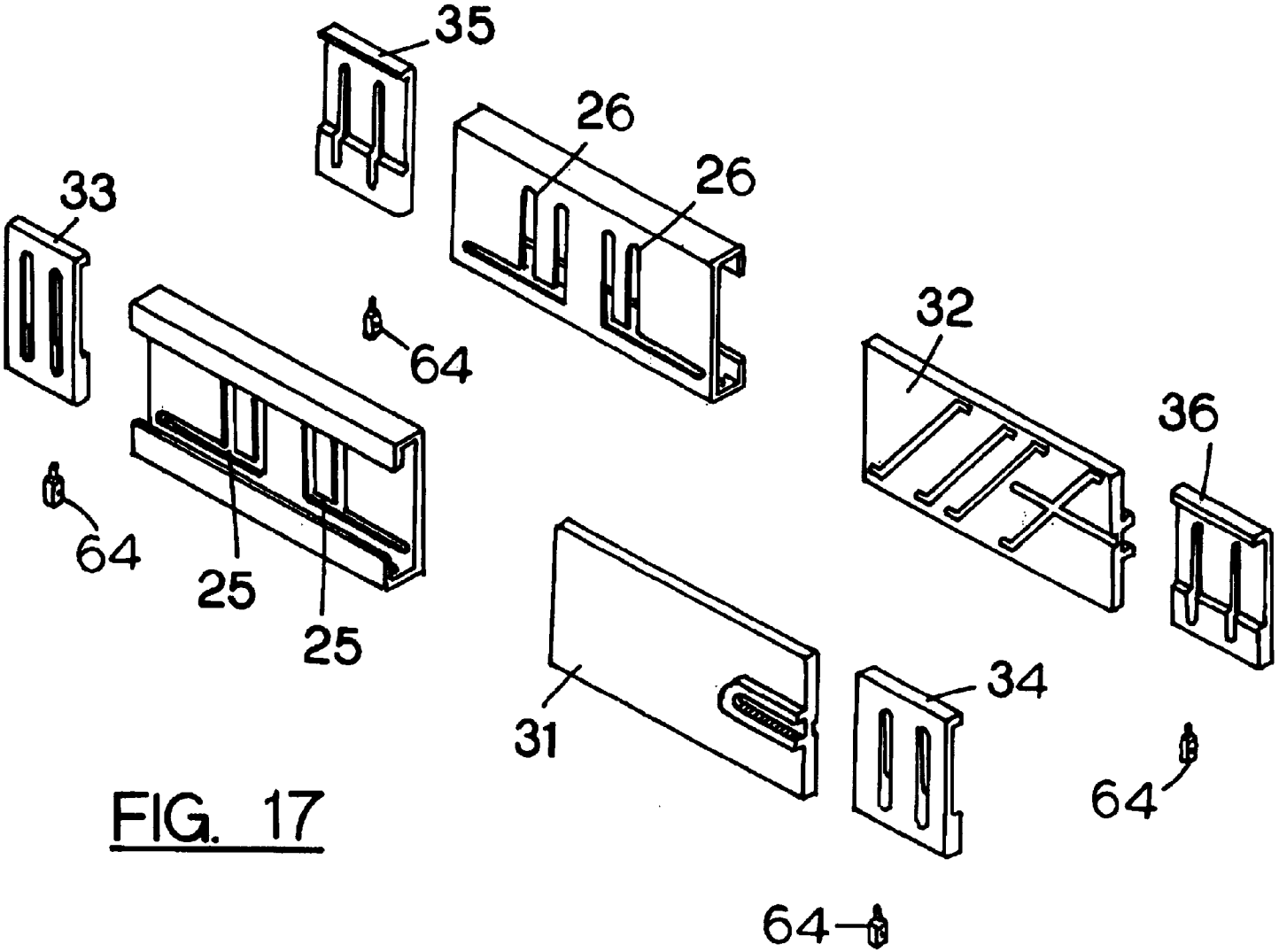
FIG. 17 is an exploded view of cams and cam channels of the commode.
Figure 21:
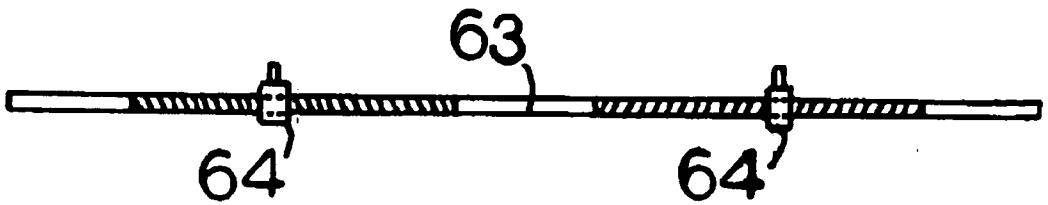
FIG. 21 is a side view of a side travel screw and the cam nut.
Figure 18:
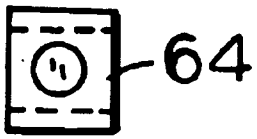
FIG. 18 is a top view of a cam nut.
Figure 20:
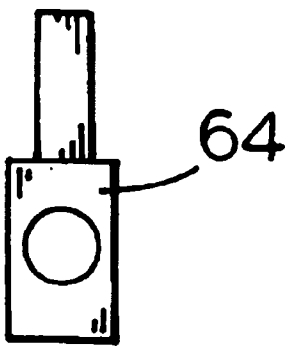
FIG. 20 is a front view of the cam nut.
Figure 19:
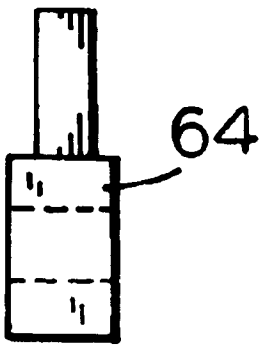
FIG. 19 is a rear view of the cam nut.
Figure 22:
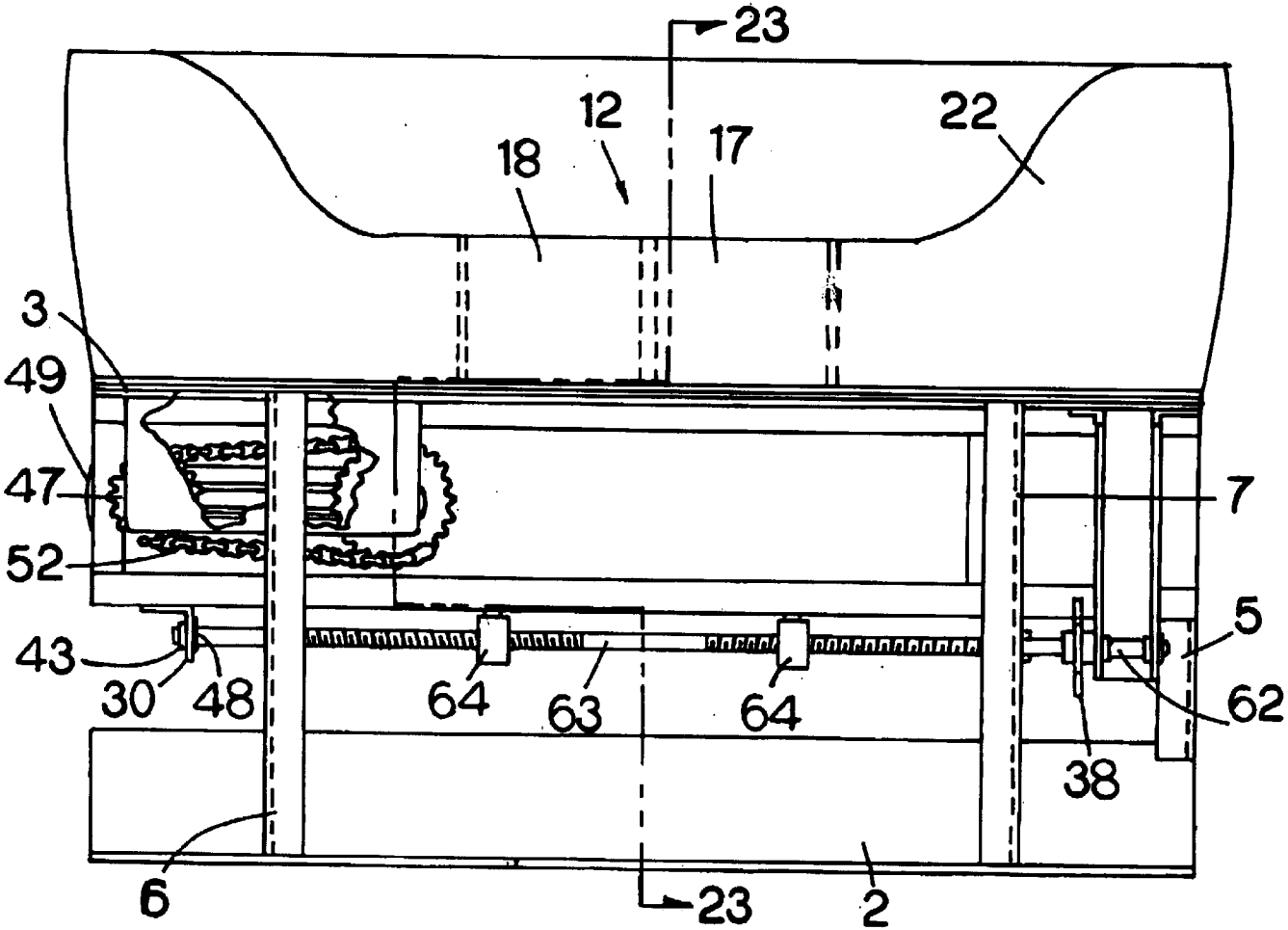
FIG. 22 is a front sectional view of the commode.
Figure 23A:
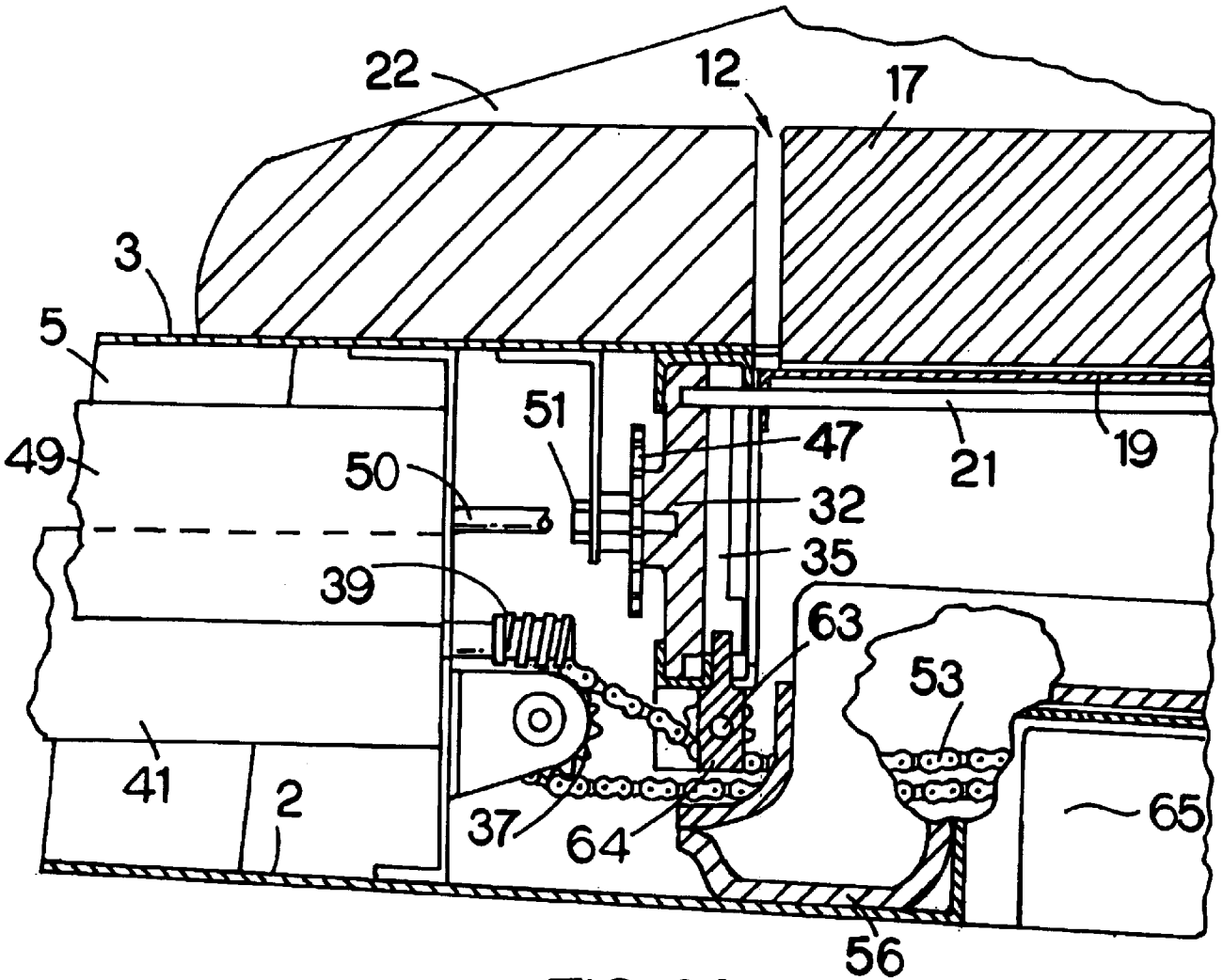
FIG. 23A is a rear side sectional view of the commode taken along line 23—23 in FIG. 22.
Figure 23B:
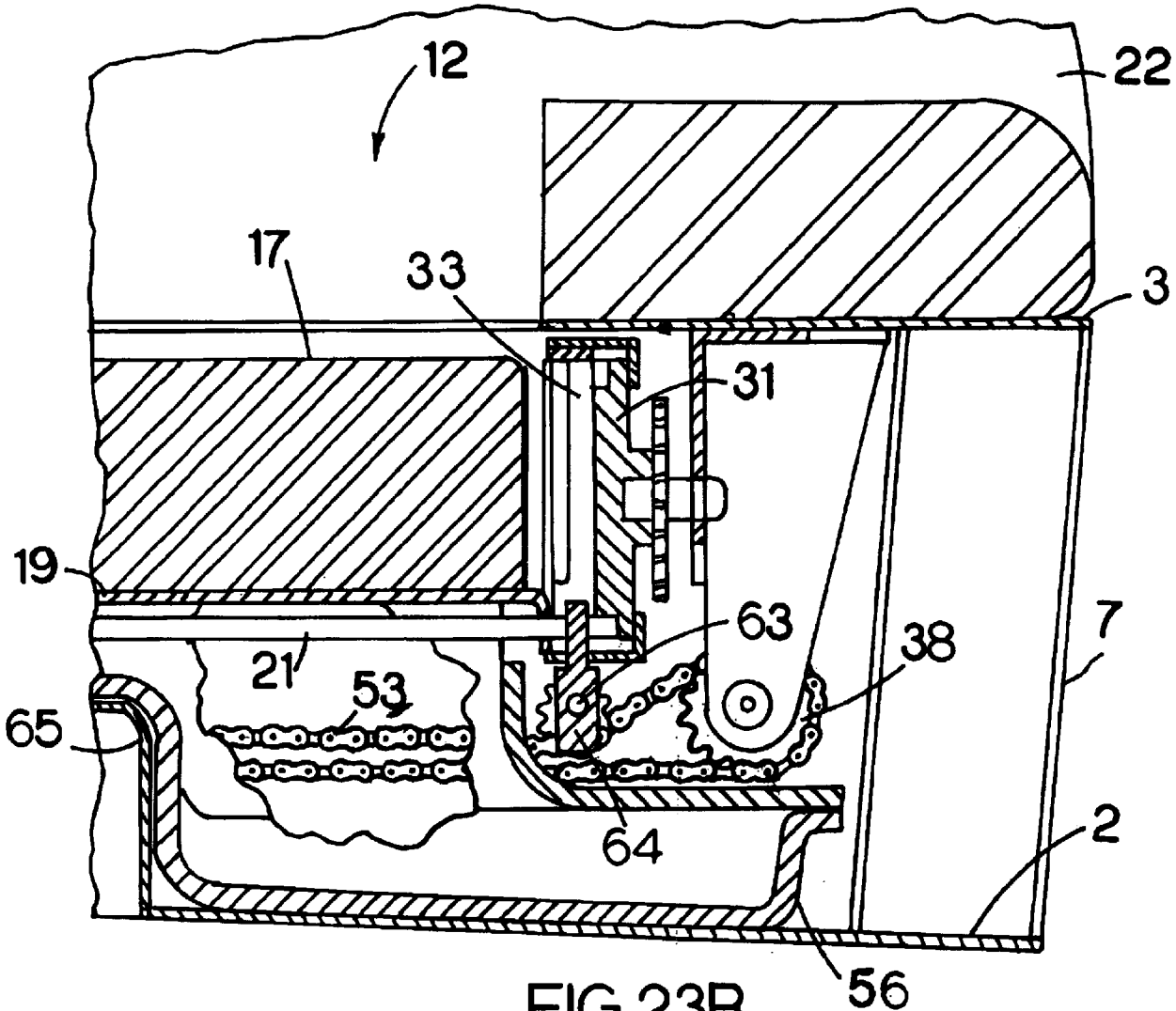
FIG. 23B is a front side sectional view of the commode taken along line 23—23 in FIG. 22.
Figure 24:
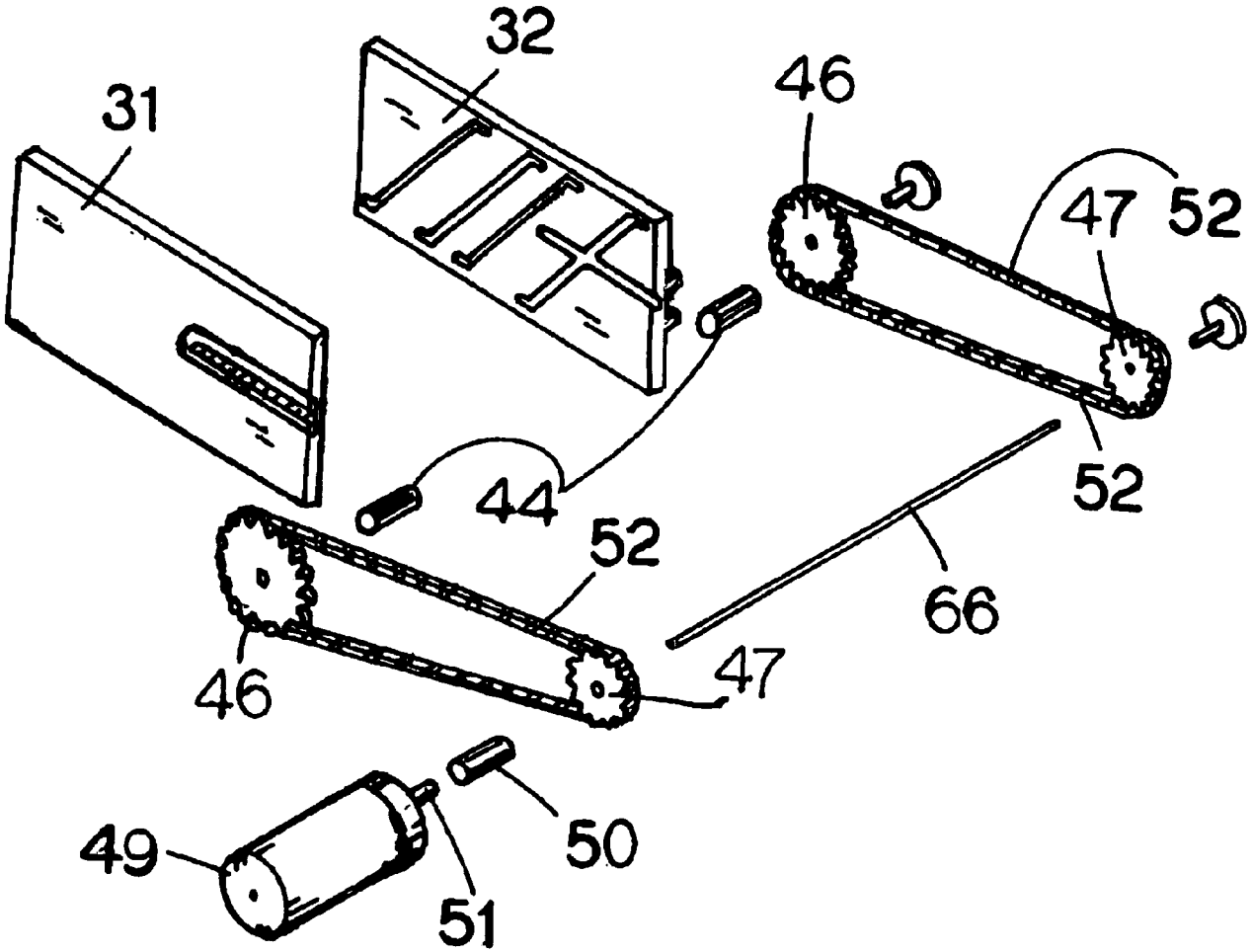
FIG. 24 is an exploded view of a vertical travel mechanism.

When the operator desires to use the commode of the present invention, the operator actuates a start switch 60 causing an elevator motor 49 to run. The elevator motor 49 drives an elevator drive shaft coupling 50 which is connected to an elevator motor shaft 51 and an elevator drive shaft 66. Turning the elevator drive shaft 66 causes two (2) elevator drive sprockets 47 to turn. The (2) elevator drive sprockets 47 engage two (2) elevator drive chains 52. The two (2) elevator drive chains 52 engage elevator pinion gear sprocket 46 which is connected to a pinion gear shaft and causes a pinion gear 44 to turn. The pinion gear 44 (shown in FIGS. 5 and 24) is enclosed in a channel which is an integral part of elevator cams 31 and 32 (shown in FIG. 17), which have a pinion gear rack meshed with the pinion gear 44. This causes the elevator cams 31 and 32 to move in a horizontal direction. This motion, as viewed from the front of the wheelchair, is from left to right.

On the opposite end side of the elevator cams 31 and 32 from the pinion gear rack there are a series of four (4) slots which capture ends of four (4) seat support pins 21. At the top, the slots have a short horizontal run so as to provide support for a left seat assembly 16 and a right seat assembly 15. The four (4) slots then turn in a downward direction at an angle generally between about thirty and about forty five degrees. This angle continues to the bottom where it turns horizontal for a short distance. The four (4) seat support pins 21 pass through holes in a seat support platform left 20 and a seat support platform right 19. The four (4) seat support pins 21 pass through vertical slots in both a fixed cam channel rear 25, a fixed cam channel front 26, and four (4) side travel cams front right 34, front left 33, rear left 35, rear right 36. As the elevator cams, front 32 and rear 31, start to move from left to right, the four (4) seat support pins 21 are unlocked and as the downward angled slots bring pressure on the pins, a downward motion is transferred to the pins which are at this point also captured in the vertical slots of the fixed cam channels, front 26 and rear 25. In addition, the seat support pins 21 are captured in and pass through the side (4) travel cams 33, 34, 35 and 36. This produces a vertical downward travel of the left seat assembly 16 and the right seat assembly 15.

Figure 16:
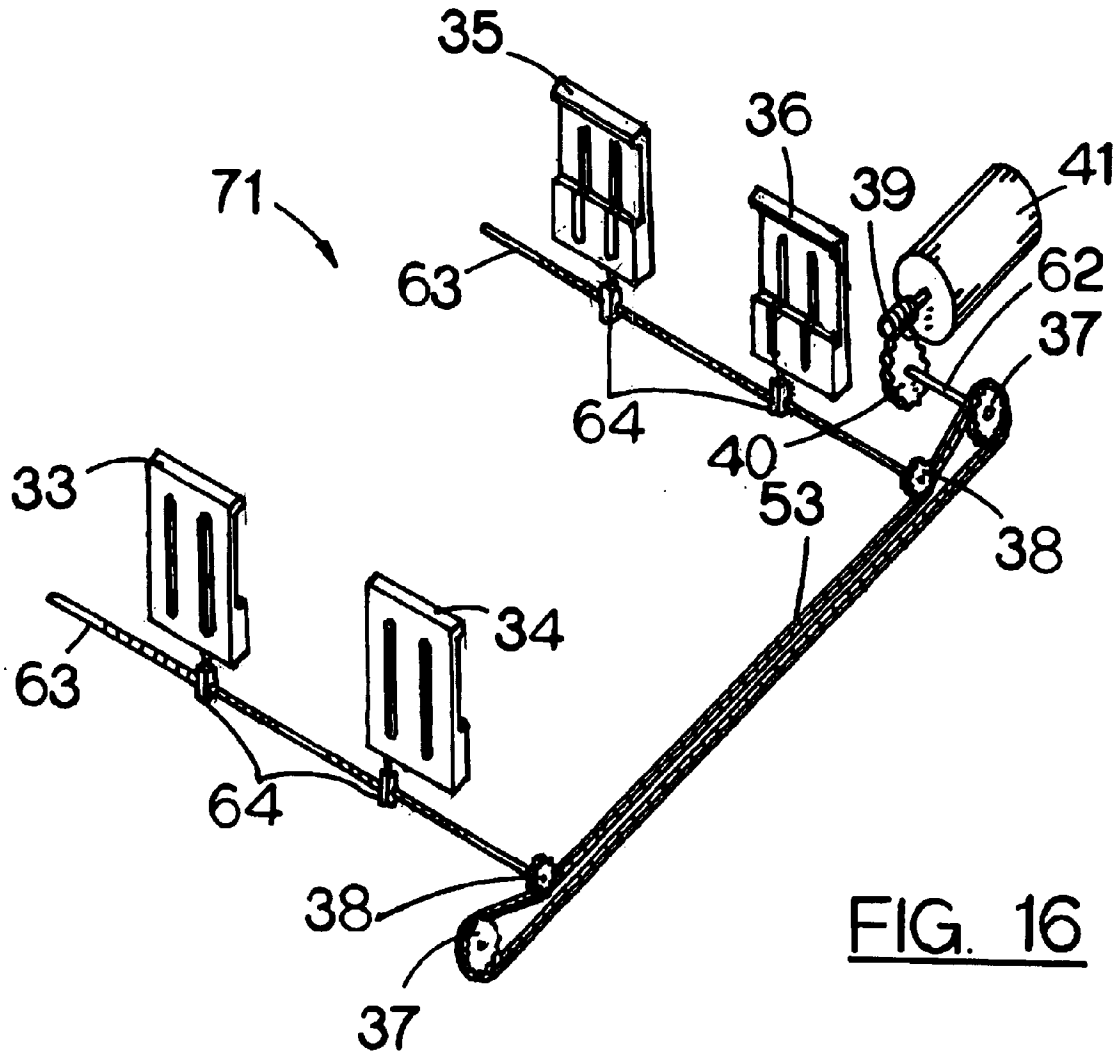
FIG. 16 is a schematic view of a side travel mechanism.

As the elevator cams, front 32 and rear 31, complete full travel, the cams actuate an elevator transfer switch which cuts off power to the elevator motor 49 and transfers power to a side travel motor 41. Turning to FIGS. 18–21, the side travel motor 41 shaft has a side travel motor shaft worm gear 39 mounted to it. A side travel mechanism 71 is shown in FIG. 16. The side travel motor worm gear 39 is meshed with a side travel sprocket shaft worm gear 40 affixed to a side travel sprocket shaft 62. The side travel sprocket shaft 62 is connected to and drives a first of two (2) side travel drive sprockets 37. The side travel drive sprockets 37 transmit power to a side travel drive chain 53. This drive chain loops around both the rear and front side travel drive sprockets 37, and two (2) side travel screw sprockets 38. As the side travel drive chain 53 moves, the side travel screw sprockets 38 rotate, turning two (2) side travel screws 63. The side travel screws 63 are also positioned by a screw bracket 30, a bushing 43, and a ring clip 48. These side travel screws 63 have both right handed threads and left handed threads, left handed threads on one end toward center, and right handed threads from the other end towards center, with a non-threaded space in the center between. Four side travel cam drive nuts 64 are screwed onto the side travel cams 33, 34, 35 and 36 with two (2) on the right handed thread side and two (2) on the left handed thread side of each of the two (2) side travel screws 63. Side travel cam drive nuts 64 extend through slots in the bottom of the fixed cam channels 25 and 26 and fit into pockets in a bottom of each of the four (4) side travel cams 33, 34, 35 and 36 and drive the side travel cams. One direction of rotation of the side travel screws 63 moves the side travel cams 33, 34, 35 and 36 away from each other moving the seat assemblies 15 and 16 to the full open position, whereupon a stop switch is actuated.

The stop switch shuts off power to the side travel motor 41 and a waste collection assembly is now accessible via an opening 12 in the seat cushion 22. The commode remains in the open mode until the control start switch 60 is moved to the close position by the user. The closing sequence is the reverse of the foregoing. The seat assemblies are moved together in a horizontal direction by the side travel cams at which point the elevator cams raise the seat assemblies back to normal level and lock in place by means of the short horizontal slots.

What is claimed is:

1. A wheelchair, comprising:

a seat having an opening, seat sections that substantially fill the opening in the seat, a waste receptacle, wherein the waste receptacle is beneath the opening in the seat, and wherein the seat sections move vertically and horizontally to provide access to the waste receptacle; and wherein the seat sections comprise a first seat section and a second seat section, and wherein the first seat section moves to a first side of the wheelchair and the second seat section moves to a second side of the wheelchair.

2. The wheelchair according to claim 1, wherein the horizontal movement of the seat sections is to one side of the wheelchair and an opposite side of the wheelchair.

3. The wheelchair according to claim 1, wherein the two seat sections are moved by two motors.

4. The wheelchair according to claim 1, wherein the waste receptacle is accessed by moving the seat sections first vertically and then moving the seat sections horizontally.

5. The wheelchair according to claim 4, wherein the waste receptacle is closed by moving the seat sections first horizontally and then vertically.

6. A wheelchair, comprising:

a seat having an opening, seat sections that substantially fill the opening in the seat, a waste receptacle, wherein the waste receptacle is beneath the opening in the seat, and wherein the seat sections move vertically and horizontally to provide access to the waste receptacle, wherein the seat sections are moved vertically by an elevator motor and then secondly are moved horizontally by a side travel motor.

7. The wheelchair according to claim 6, wherein the side travel motor rotates side travel screws, wherein the side travel screws are attached to side travel cams, and the rotating of the side travel screws moves the seat sections horizontally.

8. The wheelchair according to claim 6, wherein the seat sections comprise a left seat section and a right seat section;

wherein the side travel motor rotates side travel screws; wherein the side travel screws are attached to side travel cams;

wherein the side travel cams hold the left seat section and the right seat section; and wherein the rotating of the side travel screws moves the left seat section to a left side of the wheelchair and moves the right seat section to a right side of the wheelchair.

9. The wheelchair according to claim 6, further comprising:

pinion gears that are rotated by the elevator motor;

elevator cams having gear racks, wherein the gear racks mesh with the pinion gears;

wherein the elevator cams hold a left seat section and a right seat section; and wherein rotating the pinion gears moves the elevator cams horizontally and the left seat section and the right seat section vertically.

10. The wheelchair according to claim 1, wherein the waste receptacle comprises a flexible bag for receiving waste.

11. The wheelchair according to claim 10, wherein the flexible bag opens and closes with the movement of the seat sections.

12. The wheelchair according to claim 1, wherein the waste receptacle comprises a plastic container for receiving the waste.

13. The wheelchair according to claim 1, wherein the plastic container has an embossment.

14. The wheelchair according to claim 13, wherein the embossment is roughly c shaped.

15. The wheelchair according to claim 13, wherein the embossment conforms around a center post.

16. The wheelchair according to claim 1, further comprising electronic verification means which terminate a closing function of the seat sections when an obstruction is in the opening of the seat.

17. The wheelchair according to claim 1, wherein the seat sections' movement vertically and horizontally is initiated by toggling a switch.

18. The wheelchair according to claim 1, wherein the wheelchair power source is contained in the wheelchair.

19. The wheelchair according to claim 18, wherein the wheelchair comprises a center post for raising and lowering a seat assembly comprising the seat sections.

20. A wheelchair, comprising:

a seat having an opening, two seat sections, comprising a first seat section and a second seat section, that substantially fill the opening in the seat, a waste receptacle, wherein the waste receptacle is beneath the opening in the seat, wherein the two sections move first vertically and then the first seat section and the second seat section move horizontally to opposite sides of the wheelchair to provide access to the waste receptacle, and wherein the seat sections move first horizontally and then vertically to substantially fill the opening.

21. A method of accessing a waste receptacle incorporated into a wheelchair, comprising:

providing a wheelchair with a seat and the seat having an opening, providing seat sections, comprising a first seat section and a second seat section, that substantially fill the opening in the seat, providing a waste receptacle beneath the opening in the seat, and moving the seat sections vertically and moving the first seat section to a first side of the wheelchair and moving the second seat section to a second side of the wheelchair horizontally to provide access to the waste receptacle.

22. A commode for a wheelchair, comprising:

a seat having an opening, seat sections, comprising a first seat section and a second seat section, substantially filling the opening, a waste receptacle below the opening, motors for lowering the seat sections and moving the first seat sections horizontally to a first side of the wheelchair and moving the second seat section to a second side of the wheelchair, and wherein the commode may be installed into a wheelchair.

* * * * *